US011891858B2

(12) United States Patent
Berger et al.

(10) Patent No.: US 11,891,858 B2
(45) Date of Patent: Feb. 6, 2024

(54) METHOD AND APPARATUS FOR ALTERNATING BETWEEN CORING AND DRILLING WITHOUT TRIPPING OPERATIONS

(71) Applicant: COREALL AS, Straume (NO)

(72) Inventors: Per Erik Berger, Skien (NO); Alf Erik Berle, Rådal (NO)

(73) Assignee: COREALL AS, Straume (NO)

( * ) Notice: Subject to any disclaimer, the term of this patent is extended or adjusted under 35 U.S.C. 154(b) by 2 days.

(21) Appl. No.: 17/420,922

(22) PCT Filed: Dec. 6, 2019

(86) PCT No.: PCT/EP2019/083974
§ 371 (c)(1),
(2) Date: Jul. 6, 2021

(87) PCT Pub. No.: WO2020/143966
PCT Pub. Date: Jul. 16, 2020

(65) Prior Publication Data

US 2022/0065046 A1 Mar. 3, 2022

(30) Foreign Application Priority Data

Jan. 7, 2019 (NO) ..... 20190019

(51) Int. Cl.
*E21B 10/02* (2006.01)
*E21B 25/14* (2006.01)

(52) U.S. Cl.
CPC ..... *E21B 10/02* (2013.01); *E21B 25/14* (2013.01)

(58) Field of Classification Search
CPC ..... E21B 10/02; E21B 10/04; E21B 10/06; E21B 25/10
See application file for complete search history.

(56) References Cited

U.S. PATENT DOCUMENTS 1,923,486 A * 8/1933 Howard ..... E21B 10/26 175/254
7,913,775 B2 3/2011 Jeffryes et al.
(Continued)

FOREIGN PATENT DOCUMENTS

DE 2531446 A1 2/1977
EP 0134586 A1 3/1985
(Continued)

OTHER PUBLICATIONS

International Search Report issued in PCT/EP2019/083974, dated Mar. 9, 2020 (4 pages).
(Continued)

*Primary Examiner* — Robert E Fuller
(74) *Attorney, Agent, or Firm* — Osha Bergman Watanabe & Burton

(57) ABSTRACT

An apparatus for combined coring and drilling in a wellbore that includes a core drilling assembly with a coring drill head, an outer tubing for conveying forces to the drill head, an inner tubing with a lower end adapted for receiving a core sample. The apparatus further includes: a lifting device; closure elements with embedded cutting implements for cutting the core sample; and one or more controller device(s) for controlling activation and deactivation of the closure elements. The closure elements are connected to the core drilling assembly below an opening of the inner tubing such that, when in an open position the core sample can enter the inner tubing, and when in a closed position core material is cut and the cut core material is prevented from entering the inner tubing and exits to the borehole annulus via drill head openings provided in the wall of the coring drill head.

15 Claims, 7 Drawing Sheets

(56) References Cited

U.S. PATENT DOCUMENTS

| | | | |
|---|---|---|---|
| 8,162,080 | B2 | 4/2012 | Castillo |
| 8,739,898 | B2 | 6/2014 | Johnston et al. |
| 2002/0033281 | A1 | 3/2002 | Aumann et al. |

FOREIGN PATENT DOCUMENTS

| | | | |
|---|---|---|---|
| EP | 2877676 | A2 | 6/2015 |
| GB | 2318372 | A | 4/1998 |

OTHER PUBLICATIONS

Written Opinion of the International Searching Authority issued in PCT/EP2019/083974, dated Mar. 9, 2020 (5 pages).
Search Report issued in counterpart Norwegian Patent Application No. 20190019, dated Jul. 12, 2019 (2 pages).

* cited by examiner

METHOD AND APPARATUS FOR ALTERNATING BETWEEN CORING AND DRILLING WITHOUT TRIPPING OPERATIONS

INTRODUCTION

The present invention generally relates to extracting core samples from subterranean rock formations, and more specifically to a combined coring and drilling system offering the option to collect a core sample or to drill ahead without collecting additional sample material and doing so without performing a tripping operation.

BACKGROUND

Extracting rock core samples from boreholes has been done since the earliest days of modern hydrocarbon exploration. French engineer Rodolphe Leschot filed the first patent for a diamond-encrusted coring drill head in the United States in 1863, although mainly aimed at the mining industry. The primary objective of extracting core samples from the subsurface is to obtain detailed infom1ation about the geological strata, their physical parameters such as mineralogy and porosity, their fluid content, and the succession of strata. Until the invention of wireline logging techniques, coring was the predominant method for acquiring reliable and detailed information about subsurface. For certain types of information required as input data for modern reservoir simulation models, lab analysis of core samples is still considered to provide the most reliable data source.

Current technologies that are designed for cutting and extracting rock core samples from subterranean formations can broadly be divided into two categories. The first category is coring systems for extracting short (a few inches), small-diameter core samples from the borehole wall, i.e. transverse to the borehole axis. The second category is coring systems that collect long (up to hundreds of feet) substantially continuous and potentially larger diameter core samples along the longitudinal borehole axis, using either conventional steel pipe drill string or wireline as the conveyance method.

In the first category, U.S. Pat. No. 3,227,228 A (Bannister, 1963) discloses a well drilling and core sampling mechanism, comprising a drill string with a full-diameter drill head and a collar within the drill string containing a plurality of sample-taking devices and means for firing said devices. Such mechanisms are currently in use in the industry and are indeed suitable for collecting multiple core samples at various levels within a borehole whilst allowing certain stratigraphic intervals to be drilled through without collecting samples. However, these technologies allow only short, i.e. less than 2-inch length and a small-diameter of 1-inch or less for core samples to be collected. Furthermore, these side-wall core samples are extracted substantially parallel to the strike and dip of a given geological formation. Such samples therefore provide limited information about the sequence of strata, and continuous cores penetrating a sequence of geological layers cannot be provided.

The second category of coring systems is the most widely used in the industry, in particular where information about the nature and succession of geological strata in and near a reservoir zone is required. In its fundamental form, such a system will be an assembly comprised of a coring head, i.e. a drill bit for cutting or crushing the rock matrix, with a circular opening in the center to allow a cylindrical rock core sample to pass through; an outer tubing or "outer barrel" with an outer diameter less than the borehole diameter, which conveys the forces required to drill through the rock; and an inner tubing or "inner barrel" with substantially the same inner diameter as the center opening in the coring head, for collecting and retaining the rock core sample. To prevent a core sample from falling out of the inner tubing, the lower end or "shoe" will be equipped with a serrated ring or some other means to retain the sample, referred to as a "core catcher". The inner tubing is typically mounted on a bearing assembly at the upper end to allow the outer tubing and/or core head to rotate freely around it, whilst the inner tubing remains primarily non-rotating relative to the rock matrix. Hence, the core sample itself will be a substantially continuous cylinder of rock with the same diameter as the innermost rock-cutting segment of the core head, and up to a few hundred feet in length.

The length of the core sample is primarily limited by the length of the inner tubing and by the mechanical strength of the various geological layers being penetrated by the core drilling assembly. If mechanically weak layers are present in the core sample, these may collapse or fracture and cause a blockage or "core jamming" preventing further core sample material from entering the mouth of the inner tube.

This has practical consequences for coring operations: The length of the core barrel being run into the borehole is often restricted, either because the geological sequence is known to comprise mechanically weak layers; because the sequence is not well known, and thus potentially represents a risk of core jamming; or simply because of technological constraints in the equipment used. If the interval of interest for further analysis of core samples exceeds the length of core barrel that can be run, or if there are multiple zones of interest, this often results in multiple trips in and out of the borehole to extract the core sample and replace the inner tubing or to change between coring and drilling equipment. This imposes a significant operational cost. From an operational perspective, it would thus be more effective to be able to either (i.) continuously collect core samples without the constraints imposed by the length of the core barrel, or (ii.) to be able to sample only those intervals that are of interest for further analysis on the surface, i.e. to drill away the full cross-section of the borehole in those intervals that are not of interest, ideally without extracting the downhole equipment, and thus avoid filling up the inner tubing of the coring system prematurely. The latter solution would require (iii.) some method for assessing the nature of the subsurface geology while it is being drilled.

U.S. Pat. No. 3,578,093 A (Elenburg, 1969) proposes a solution to the first problem (i.) that utilizes the hydraulic differential pressure of the circulating drilling fluid to pump shorter segments of the core sample to surface, thereby avoiding that the inner barrel fills up with sample material and allowing the coring process to continue for as long as required. This method has not become commonplace in the industry, and it is not known if such a system has ever been tested in the field.

Decades ago, Eastman Christensen Company, a predecessor to Baker Hughes, Inc., developed a combination drilling and coring system that allows alternate coring and drilling operations without tripping the drill string, i.e. a solution to the second problem (ii.). This system utilized an inner barrel assembly for coring and a substitute center plug assembly that could enter the core bit and convert it to a drill bit. Both devices were deployable and retrievable via wireline, i.e. the inner barrel assembly and center plug were nm in and out of the borehole inside the drill string. Similar systems are described in U.S. Pat. No. 6,006,844 A (Van Puymbroeck, 1999), and in Halliburton Coring Services Product Catalogue (HAL03023, July 2009), and are not uncommon in the industry.

However, there are some constraints associated with such wireline retrievable coring systems. Foremost, the core sample diameter will be restricted by the inner diameter of the drill string, effectively reducing the core diameter to two inches or less, although some modern systems allow slightly larger diameter cores. This can make the core samples unsuitable for certain important types of laboratory analysis. Additionally, the maximum core length that can be cut at one time tends to be quite short; between ten and twenty feet only, in the first versions of this technology. This provides an extremely short interval for analysis without multiple trips of the inner tube assembly.

Although efficient for a single trip, multiple trips in and out of the borehole inside the drill string will be time consuming. Hence, much of the time saved by not having to trip the entire drill string out of the hole to change from coring to drilling, and vice versa, is lost in tripping the wireline retrievable drill-plug/coring assembly in and out of the drill string, especially for longer zones of interest to be cored. It is also far from desirable to be operating a wireline with tools inside the drill string as it complicates the well control operation in case of a situation where fluids are entering the wellbore, known in the art as a kick or a blow-out.

Finally, because such a system requires a continuous full inner diameter of the drill string to be deployed, it is not possible to combine this technology with other tools that occupy the inside of the drill string. During full-bore drilling, i.e. when not collecting core samples, it 1 s common m the industry to place a Measurement While Drilling (MWD) tool in the drill string as close to the drill bit as possible to provide data in real-time about the subsurface and the ongoing drilling operations. Such MWD tools cannot facilitate a thru bore that would allow a wireline retrievable coring system with a drill bit plug to pass through it.

Consequently, a wireline deployable coring system cannot be combined with an MWD system. The combination of a true Measurement While Drilling system in combination with coring has only been solved by the assignee, as described in patent EP 2877676 BI (Berger, 2012), further described below, and incorporated herein for all purposes by this reference.

U.S. Pat. No. 8,162,080 A1 (Castillo 2007) describes a method and apparatus for "continuous or substantially continuous" coring of subsurface formations that could serve to solve the described challenges (ii.) and (iii.), above. In its fundamental aspect, the method includes drilling into a formation to retrieve a core from the formation; receiving the retrieved core into a first chamber; and removing a portion of the core up-hole of the first chamber to continue to receive the core into the chamber as the drilling continues. A further description is provided wherein the device for removing a portion of the core sample is subsequently deactivated to receive a core into a second chamber for storage.

The apparatus associated with this method is described as comprising a drill bit, i.e. a coring drill head; two distinct chambers, the first for initially receiving the core sample and the second for storing the core samples; and a cutting device placed between the two chambers that can remove a portion of the core uphole of the first chamber. The system may also include one or more sensors for estimating properties of a core, the subsurface formation and/or the wellbore fluid of a continuously obtained core.

The cutting apparatus is further described as potentially being permanently activated to allow continuous coring by cutting away the top end of the incoming core sample. In another embodiment, the cutting device may potentially be activated and deactivated multiple times to allow discrete core samples to be collected at different formation depths. The cutting device is also described as being powered by a designated power unit.

However, there are some challenges with the proposed solution. Firstly, a cutting device with its own power unit to provide the forces required to perform the cutting action would likely require more power than is presently feasible in a downhole device. Secondly, the volume of rock that is being cut from the core sample will need to be removed from inner tubing or chamber and dispatched into the return drilling fluid stream in the borehole annulus, and no solution for this is disclosed in the available documentation. Thirdly, an open chamber some distance away from the coring head, i.e. wherein the stationary core sample is exposed to the rotating outer barrel, is likely to significantly increase the risk of core jamming. This may eliminate the possibility of achieving a continuous coring-and-drilling operation, which is the central concept in the first place. Consequently, a different solution to the challenge of selectively coring or drilling away subsurface formations is presented herein, as further described below.

EP 2877676 B1 discloses a system for selectively altering between coring and drilling modes within the same system and using data collected downhole to determine in real-time if it is of interest to collect a core sample of the subsurface formation or not. However, we are not aware of any such system that is currently in existence in full and is suitable for use in oil and gas exploratory wells, although elements of such a system have indeed been constructed by the assignee of said patent and been proven functional.

EP 2877676 B1 describes some "grinding means" that may be included to remove unwanted core material by grinding or drilling it into small pieces of rock that can be discharged into the return mud flow and thus removed from the core. Upon completion of the process of cutting a core, the grinding means could be activated, thus cutting off the core at its position. Drilling may then resume after coring by using a combination of a core bit and a grinding means, thus eliminating the need to trip to surface to change from a coring assembly with a core bit to a drilling assembly with a drill bit. Furthermore, the grinding means can remove unwanted core material, such as formations of no interest for further inspection. The grinding means could also function as a core catcher, preventing the core sample from falling out of the coring drilling assembly if the assembly is lifted from the bottom of the drilling hole.

The coring system is further described as potentially including sensors that provide information about the characteristics of the cored material as it is being sampled. This information may be used to decide which sections of the core that is of interest and that can be collected, and which sections that are of no interest and that can be discarded, either by manual determination and commands sent by an operator on the surface, or automatically downhole. With downhole sensors and data processing and analysis capabilities, altering between modes of keeping or discarding the cored material could be done automatically by the apparatus, also in situations where no sensor information is transmitted to surface.

In the illustrations of patent EP 2877676 B1, the grinding mechanism is shown some distance away from the core drill head, above the range of sensors that collect information about the core sample or the subsurface rock formations, yet below the inner tubing. A crucial element of such a solution is that the core sample as such will then pass through an interval where it will be exposed to the rotating inner wall of the outer tubing, prior to entering the inner tubing or being intersected by the grinding means.

The inventors of the present invention have built and tested such a solution, without the grinding mechanisms, i.e. a core drilling apparatus comprising an interval that the core sample passes through, which is exposed to the rotating inner wall of the outer barrel. The results from this testing make it evident that such a solution increases the risk of core jamming, i.e. that the core sample may disintegrate and plug the annulus within the outer tubing. The solution could potentially work, but only in the event that the geological formation being sampled is very homogenous and competent, such as for certain types of crystalline rocks, and where vibrations in the core drilling equipment are at a minimum. In stratigraphic sequences where the geological formations are interbedded, as is commonly the case in areas where hydrocarbon exploration is conducted, the presence of weak layers are likely to cause the core sample to detach from the substrate and break up: As the core sample breaks, the forces exerted by the core drilling equipment cause fragments of the core sample to expand transversely, placing them in contact with the rotating inner wall of the outer tubing. This exposes the fragments to rotational forces, which may cause further breakup of the core sample and eventually a complete plugging of the equipment in the annulus. We consider the design described in EP 2877676 B1, and the design disclosed by Castillo (2007), to both suffer from this limitation, thus rendering these designs less suitable for achieving the purpose of drilling ahead without collecting core material.

The consequences of these findings are that a method and apparatus are required that minimizes the distance from the cutting surface of the coring drill head to the protective inner tubing whenever a core sample is collected, similar to the state of the art in conventional core drilling equipment. Correspondingly, when an internal cutting apparatus is activated, and drilling mode is initiated, the cutting surface of said apparatus must be within inches of the cutting surface of the coring drill head, and closure must occur below the inner tubing. This can only be achieved if the closure or cutting apparatus is placed within or very close to the coring drill head and may require that the inner tubing be moved along the longitudinal axis. A method and apparatus for dispatching the cut rock fragments into the return drilling fluid flow must also be found. Additionally, the cutting device may not necessarily require its own power source, as the rotational force of the coring drill head or outer tubing should be sufficient to disintegrate the rock formation once the device is closed.

Further details of this method and the associated apparatus is provided in the present disclosure, and any additional ideas and comments to said original patent EP 2877676 B1, e.g. regarding the use of sensors to determine if a core sample should be collected or not, are fully incorporated herein with this reference.

The present invention provides a solution overcoming said problems and generally relates to extracting core samples from subterranean rock formations and, more specifically, to a combined coring and drilling system offering the option to collect a core sample or to drill ahead without collecting additional sample material, without retrieving any equipment from the borehole.

Optionally, the system will have the capability to concurrently log a formation being cored as well as the core sample being cut from the formation and transmitting this information to the surface to be used as a basis for the decision of whether to collect a core sample or not, or the system may perform this function automatically.

SUMMARY OF THE INVENTION

The present invention discloses an apparatus and method for enabling a core drilling assembly to also be used for drilling ahead without collecting additional core sample material, thereby potentially reducing the frequency of extracting the core drilling assembly from the borehole. This is achieved by closing or substantially closing the center opening of the coring drill head, below the inner tubing, and having cutting implements embedded in the elements used to close the center opening of the coring drill head. With the center opening in the coring drill head closed and the closure elements being equipped with cutting implements, rock entering the center opening of the coring drill head will be disintegrated and no additional core sample can enter the inner tubing. To remove debris or rock fragments from the center opening of the coring drill head as drilling progresses, ports in the drill head may open into the annulus between the drill head and the borehole wall, allowing the debris to be carried to surface with the return flow of drilling fluid.

The apparatus according to the invention enables combined coring and drilling in a wellbore without performing a tripping operation. The apparatus comprises a core drilling assembly with a coring drill head, an outer tubing for conveying forces to the core bit, an inner tubing with an upper end connected to a bearing assembly and a lower end adapted for receiving a core sample. The inner tubing may in one embodiment comprise retention means for preventing the collected core sample from exiting the inner tubing.

The apparatus is characterized in comprising closure elements with embedded cutting implements for cutting core sample. The closure elements are connected to the core drilling assembly at the lower end and below the opening of the inner tubing such that, when in an open position enables core sample to enter the inner tubing, and when in a closed position prevents core material from entering the inner tubing and then cut core material letting it exit to the borehole annulus via openings provided in the wall of the coring drill head. The apparatus further comprises one or more controller device(s) for activating and deactivating the closure elements.

In one embodiment of the apparatus, a lifting device is connected to or arranged as a part of the bearing assembly of the inner tubing.

The lifting device is in one embodiment connected to the bearing assembly connected to the inner tubing for controlling the position of the bearing assembly along the longitudinal axis of the core drilling assembly, and where the lifting device is operated by drilling fluid flow by means of one or more conduits, valves and pistons arranged in the outer tubing, thus using the hydraulic force of the drilling fluid to power the lifting device. A lifting device may also include sensors for determining parameters such as piston position, valve position, pressure etc.

In a first embodiment of the apparatus, the closure elements are connected to the outer tubing, and then preferably immediately above the coring drill head such that the closure elements can be pushed into the center opening of the coring drill head. In a second embodiment, the closure elements are connected to the drill head. The closure elements may be hinged to the outer tubing or the drill head.

According to one embodiment of the invention, the coring drill head comprises internal conduits allowing flow of rock fragments and debris into the drilling fluid return flow in the borehole annulus.

In one embodiment of the invention, the apparatus for combined drilling and coring comprises one or more sensors installed near the drill head for detecting properties of the coring process. The sensor may be connected to the one or more controller device(s) for controlling operation of coring or drilling modes.

The invention is further defined by a method for changing between drilling and coring modes of an apparatus for combined drilling and coring operations in a wellbore without performing a tripping operation. Said apparatus comprises a core drilling assembly with a coring drill head and a core bit, an outer tubing for conveying forces to the core bit, an inner tubing with an upper end connected to a bearing assembly and a lower end adapted for receiving a core sample. Changing between modes while drilling is characterized by activating or deactivating closure elements, that are connected to the core drilling assembly at the lower end and below the opening of the inner tubing, for changing between an open or closed position, thereby opening or closing access to the inner tubing, and where the closure elements are provided with embedded cutting implements for cutting core material when in a closed position.

According to one embodiment of the method, drilling mode is activated by closing the closure elements thereby preventing core material from entering the inner tubing, thereby enabling cutting of core material with said embedded implements and letting it exit to the borehole annulus via openings provided in the wall of the coring drill head. Coring mode is activated by opening the closure elements allowing core sample to enter the inner tubing.

According to one embodiment, controlled coring is performed by selectively activating and deactivating the closure elements, while continuously drilling through a formation. This will provide core samples at different stratigraphic levels without performing a tripping operation.

In one embodiment, activation or deactivation of the closure elements is performed by redirecting drilling fluid flow running between the inner tubing and outer tubing. In another embodiment, activation and deactivation of the closure elements is performed by means of electromotor and/or integrated hydraulics. In yet another embodiment, activation or deactivation of the closure elements is performed by lifting or lowering the inner tubing.

The method is in one embodiment further defined by activating or deactivating an internal lifting device for moving the inner tubing away from or toward the end of the coring head. The internal lifting device can in one embodiment be activated or deactivated by redirecting drilling fluid flow running between the inner tubing and outer tubing. In another embodiment, the internal lifting device is activated or deactivated by means of an electromotor and/or integrated hydraulics.

SHORT DESCRIPTION OF THE DRAWINGS

The present invention will be described in detail with reference to the following figures.

The following figure references are used.

100—core drill head
103—channel
110—outer tubing
120—inner tubing
130—bearing assembly
140—conveyance means
150—core sample
160—drilling fluid
161—inner annulus
162—borehole annulus
200—core drill head
201—closure elements
202—drill head opening
203—channels
204—channel branch
205—hinge element
206—upper seal
207—lower seal
208—cutting implements
210—outer tubing
220—inner tubing
221—inner tubing end
222—bearing assembly
230—lifting device
231—controller device
232—upper piston
233—lower piston
234—internal upper volume
235—internal lower volume
236—valve
237—first conduit
238—second conduit
239—bracket
240—conveyance means
250—core sample
251—rock formation
255—retention means
260—drilling fluid
261—inner annulus
262—borehole annulus

DETAILED DESCRIPTION OF THE INVENTION

For detailed understanding of the present invention, reference is made to the following description of the apparatus and method, taken in conjunction with the accompanying drawings.

The present invention discloses an apparatus and method enabling a core drilling assembly to also be used for drilling ahead without collecting additional core sample material, thereby potentially reducing the frequency of extracting the core drilling assembly from the borehole. This is achieved by closing or substantially closing the center opening of the coring drill head, below the inner tubing, and having cutting implements embedded in the elements used to close the center opening of the coring drill head. With the center opening in the coring drill head closed and the closure elements being equipped with cutting implements, rock entering the center opening of the coring drill head will be disintegrated and no additional core sample can enter the inner tubing. To remove debris or rock fragments from the center opening of the coring drill head as drilling progresses, ports in the drill head may open into the annulus between the drill head and the borehole wall, allowing the debris to be carried to surface with the return flow of drilling fluid.

Figure 1:
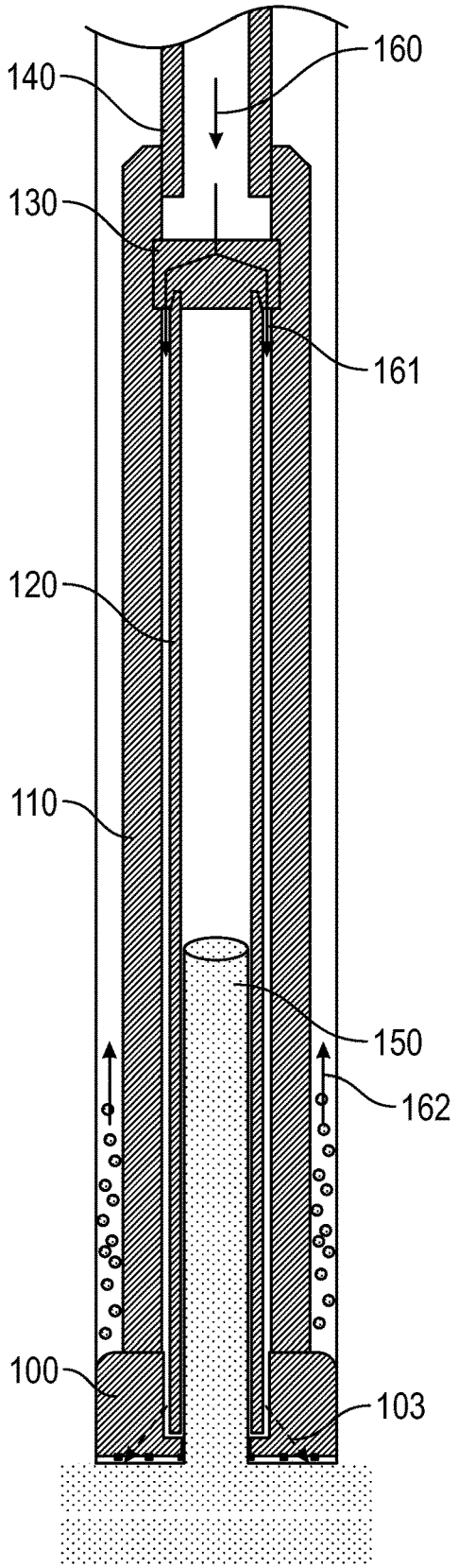
FIG. 1 (Prior Art)
FIG. 1 shows a conventional core drilling assembly.

FIG. 1 illustrates a conventional core drilling assembly as known in the industry, comprising a coring drill head 100 with a circular opening in the center to allow the core sample 150 to pass through; an outer tubing 110 for conveying forces to the coring drill head 100; an inner tubing 120 for collecting and retaining the core sample 150; a bearing assembly 130 that allows the outer tubing 110 to rotate freely around the inner tubing 120; and some conveyance means 140, typically a drill pipe. Drilling fluid 160 is pumped from a drilling rig on the surface through the drill pipe and diverted into the inner annulus 161 between the inner and outer tubing 110. At the coring drill head 100, the drilling fluid 160 is diverted into channels 103 in the coring drill head 100 to exit through ports at the cutting surface of the coring drill head 100, whereupon the return flow of drilling fluid 160 carries rock fragments that have been crushed by the coring drill head 100 back up to surface in the borehole annulus 162 between the outer tubing 110 and the borehole wall. In an assembly similar to this, once the full length of inner tubing 120 has been filled with core sample 150, the inner tubing 120 will need to be extracted from the borehole, either by first extracting the full assembly, or by using wireline or other means to retrieve the inner tubing 120 through the drill string. If it is not desired to take core samples 150 from a particular geological sequence of strata, the core drilling assembly will need to be extracted from the borehole and replaced with a full diameter drilling assembly.

Figure 2:
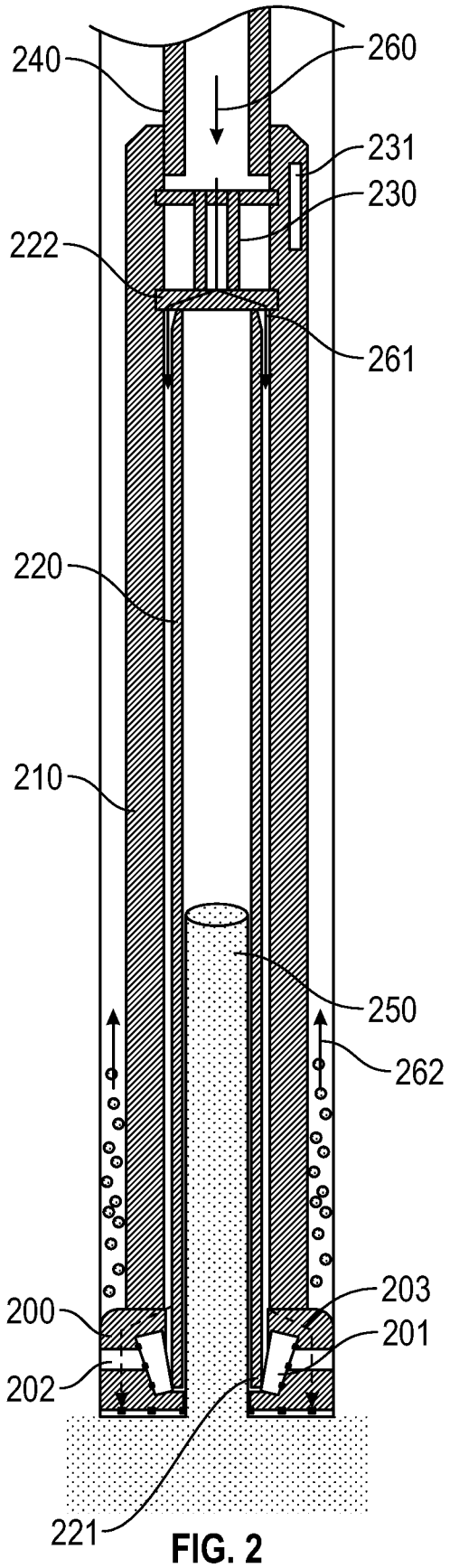
FIG. 2 shows features of the invention in coring mode.

FIG. 2 illustrates an example of the present invention in coring mode. It is then set up for collecting core samples 250. The core drilling assembly comprises a special coring drill head 200 with a closure element 201 comprising two elements retracted into the wall of the drill head housing and drill head openings 202 in the wall for debris to exit into the borehole annulus 262 (outer annulus), although these openings are predominantly closed off by the retracted closure elements 201; an outer tubing 210 and an inner tubing 220 for collecting and retaining a core sample 250; both tubings may be wired for transmission of electrical power and data. As is the industry standard, some conveyance means 240 is connected to the upper end of the core drilling assembly. Unlike a conventional system, the bearing assembly 222 for the inner tubing 220 may be connected to or part of a lifting device 230. An arrangement of valves and pistons may direct the internal flow of drilling fluid 260 to provide hydraulic power to the lifting device 230 when required and directs most of drilling fluid 260 into the inner annulus 261 between the inner and outer tubing 220, 210 for coring operation. A controller device 231, such as an electronic processor board, connected to actuators or similar, may be set up to receive commands from an onboard processing unit or from the surface drilling rig, and controls the actions of the valves and pistons of a lifting device 230. The lifting device 230 is illustrated in the extended position, so that the distal inner tubing end 221 is in the immediate proximity of the cutting surface of the coring drill head 200, and a core sample 250 may pass unhindered into the inner tubing 220. Within the coring d1iJI head 200, channels 203 direct all or some of the drilling fluid flow out onto the cutting surface of the coring drill head 200, to allow cooling and removal of rock debris, which is further circulated up through the borehole annulus 262.

Figure 3:
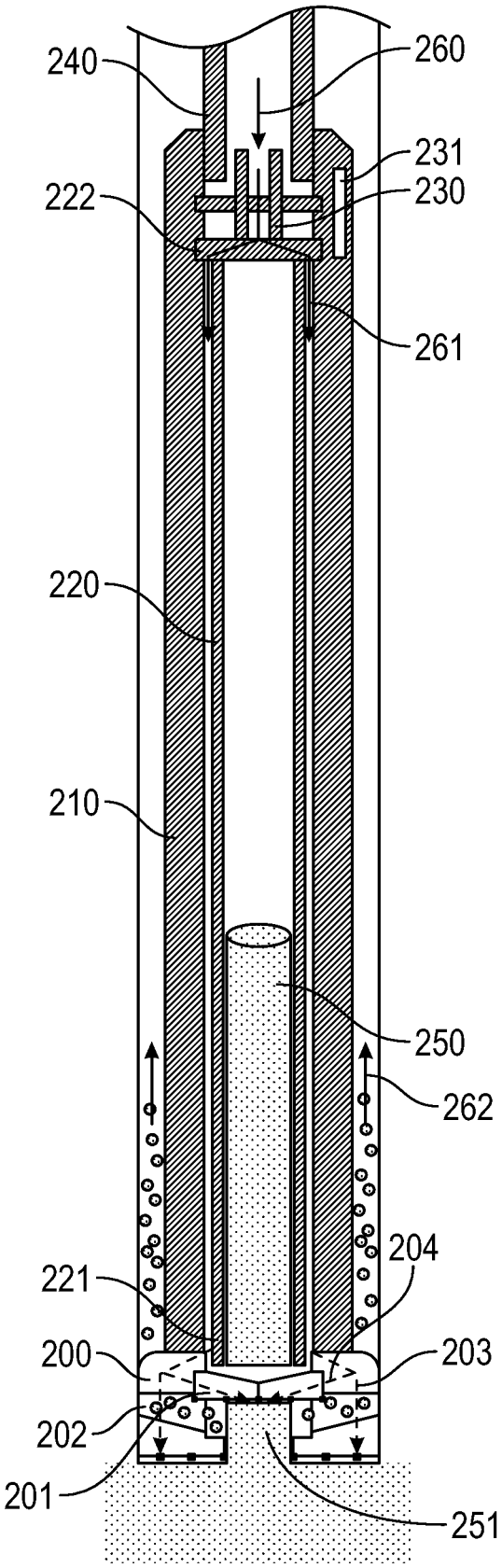
FIG. 3 shows features of the invention in drilling mode.

FIG. 3 illustrates an example of the present invention in drilling mode. It is then set up for drilling ahead without collecting additional core samples 250. In dril1ing mode, the coring drill head 200 is shown with the closure elements 201 in a closed, interlocked position, forming a secondary rock-cutting surface with embedded cutting implements 208. This opens designated channel branches 204 in the coring drill head 200 to redirect a fraction of the internal drilling fluid 260 flow in the inner annulus 261 onto the cutting surface of the closure elements 201, whereas most of the flow is directed into channels 203 that lead to the main cutting surface of the coring drill head 200. Within the coring drill head 200, the channels or drill head openings 202 to the borehole annulus 262 are now open, allowing the discharge of rock fragments and debris into the return flow of the drilling fluid 260 in the borehole annulus 262. In the illustration, the lifting device 230 is shown in its retracted or compressed state, with the distal inner tubing end 221 retracted to a position above the closure elements 201. Any core sample 250 previously collected will be contained within the inner tubing 220. An arrangement of sealing rings may further be introduced between the outer tubing 210, or the coring drill head 200, and the inner tubing 220 to provide additional protection for the collected core sample 250. With the invention set up in the described state, any segment of the rock formation 251 that enters the center opening of the core drill head 200, will be crushed by the embedded cutting implements 208 of the closure elements 201, and no further core sample 250 will enter the inner tubing 220. It can easily be deduced that if the entire core drilling assembly is lifted off the bottom of the borehole, the closure elements 201 may be reopened and the inner tubing 220 returned to its lowermost pos1t10n, and the core drilling assembly may be lowered back to the bottom of the borehole to allow further core samples 250 to be collected.

Figure 5:
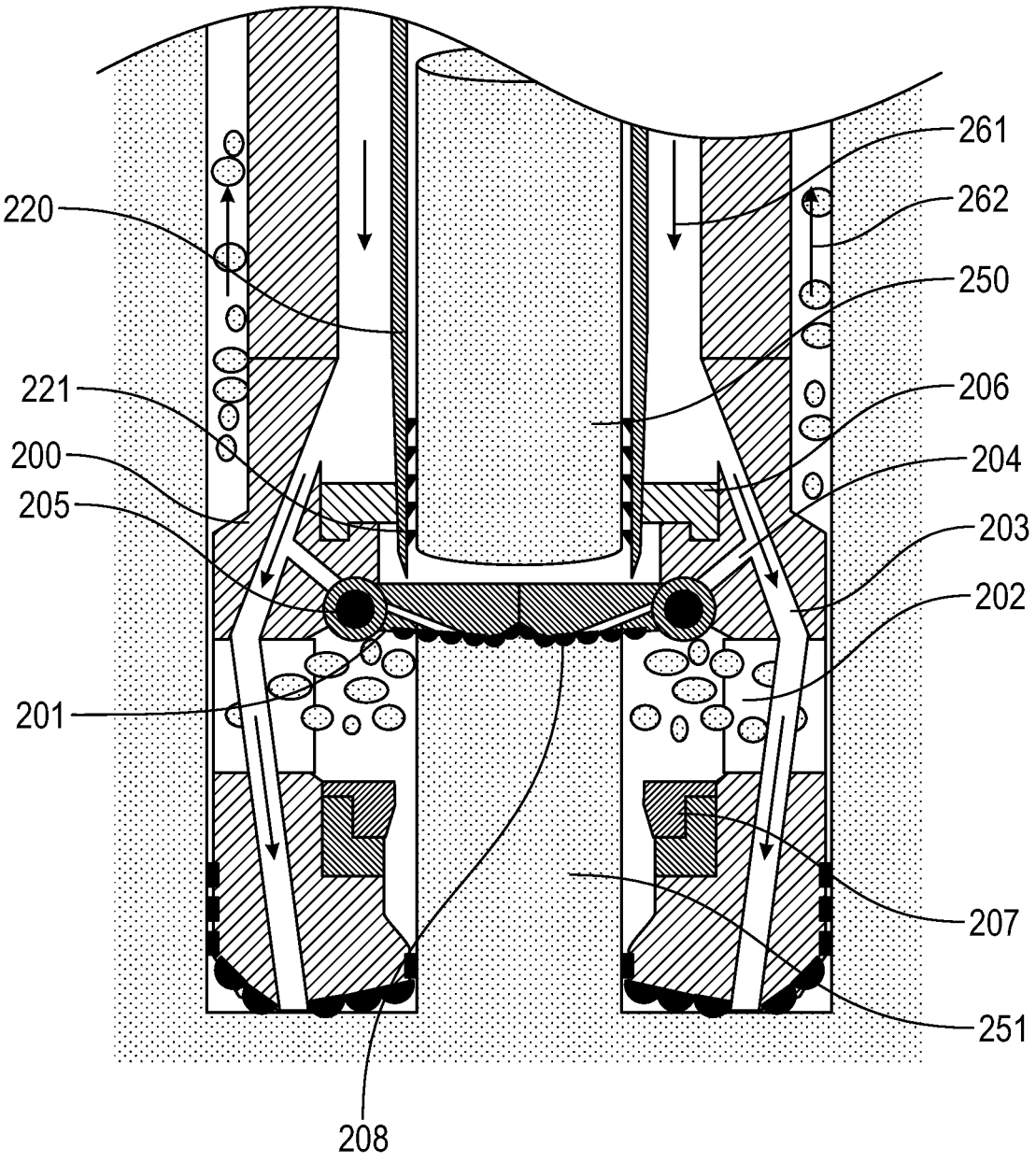
FIG. 5 shows details of an embodiment of the invention with core drill head in full-bore drilling mode.
Figure 6:
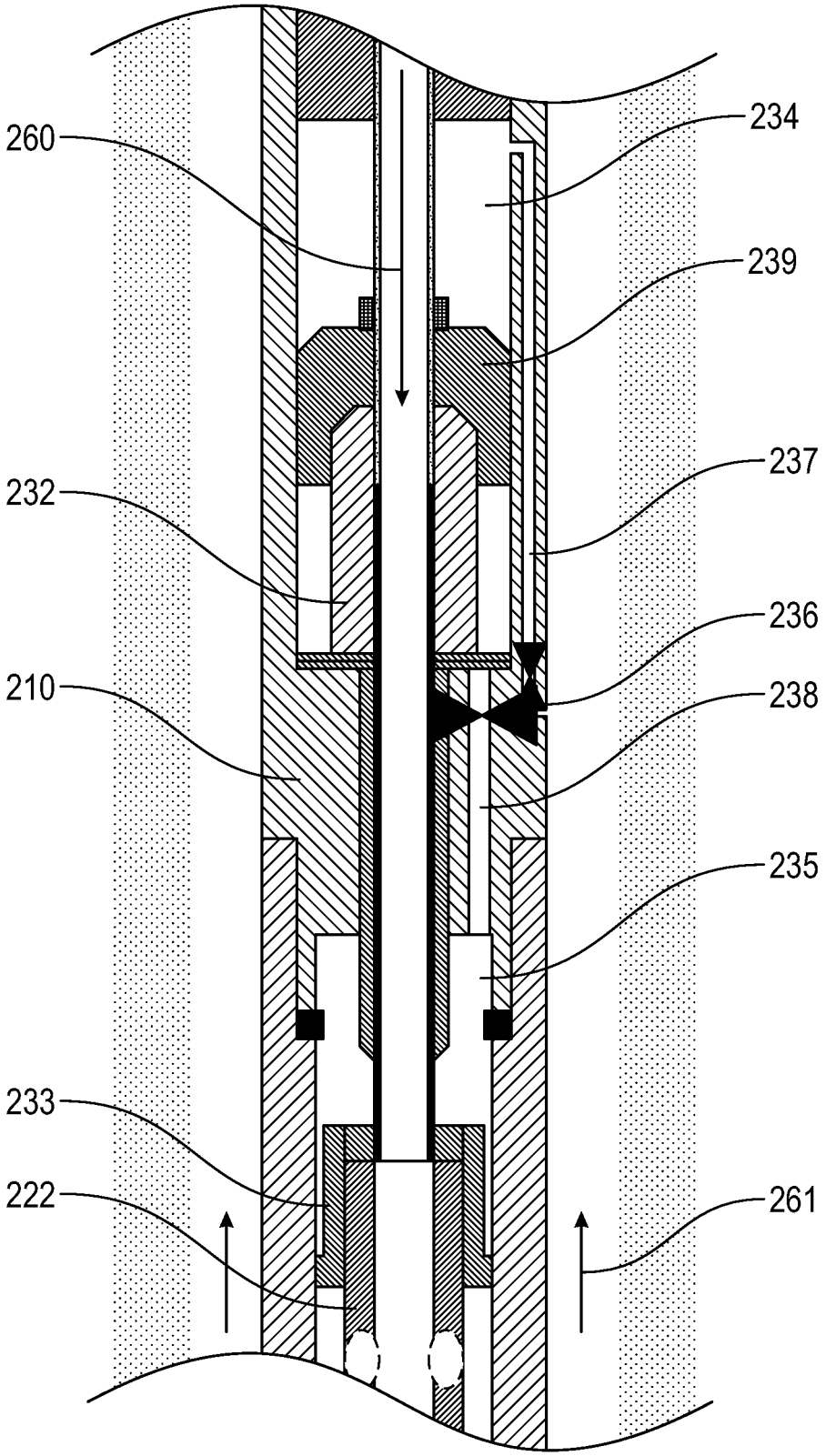
FIG. 6 shows details of an embodiment of the invention with lifting device in coring mode.
Figure 7:
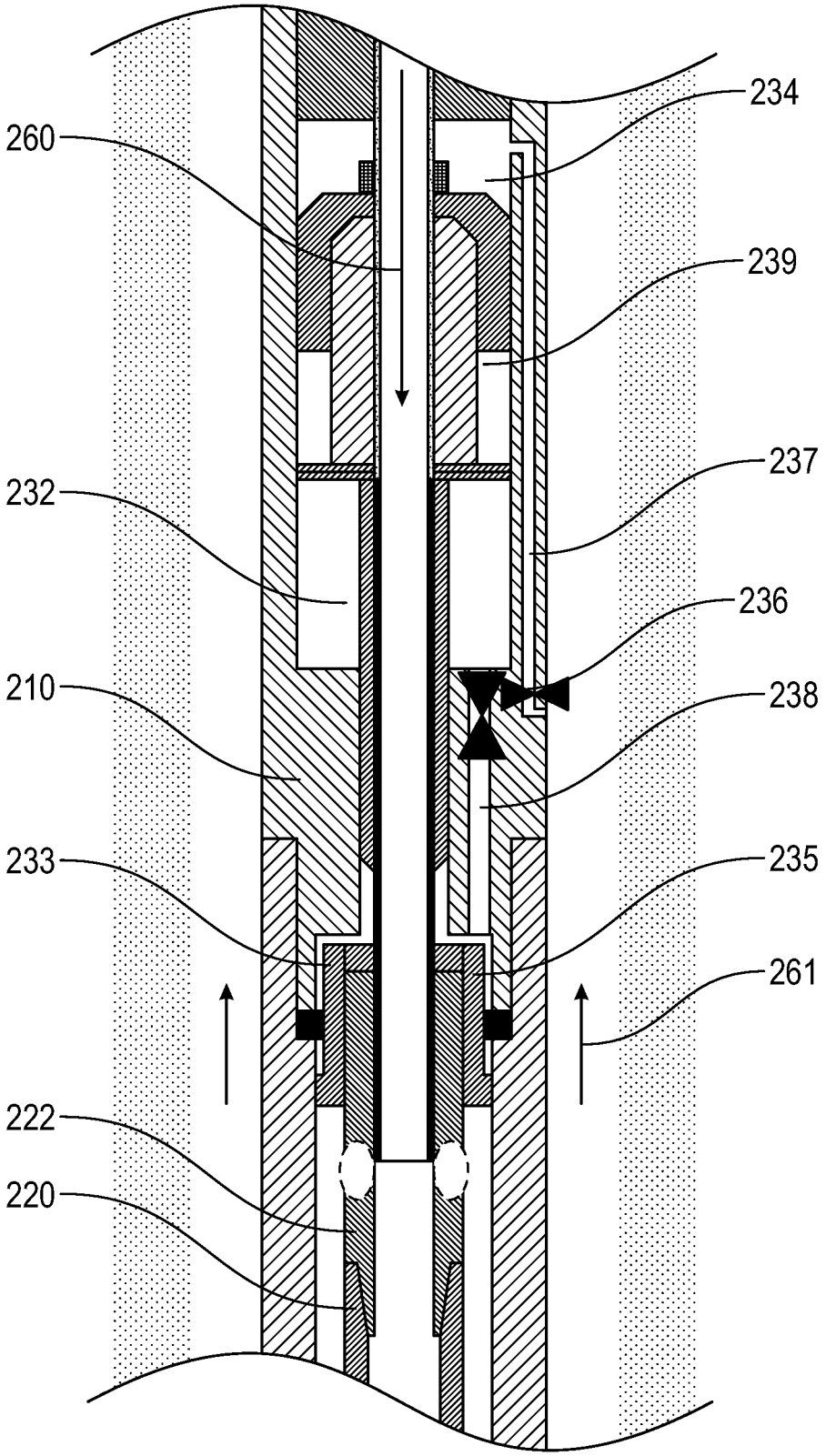
FIG. 7 shows details of an embodiment of the invention with lifting device in full-bore drilling mode.

Additional details regarding a possible embodiment of the present invention are disclosed in FIGS. 4 to 7 described below. In the described embodiment, the solution for alternating between coring and full-bore drilling involves two separate apparatuses. The lower part of the apparatus, shown in FIGS. 4 and 5, is a specially designed modified coring drill head 200, and the upper part of the apparatus, shown in FIGS. 6 and 7, is a lifting device 230 for the inner tubing 220, which allows the inner tubing 220 to be moved up or down along the longitudinal axis of the drilling assembly.

Figure 4:
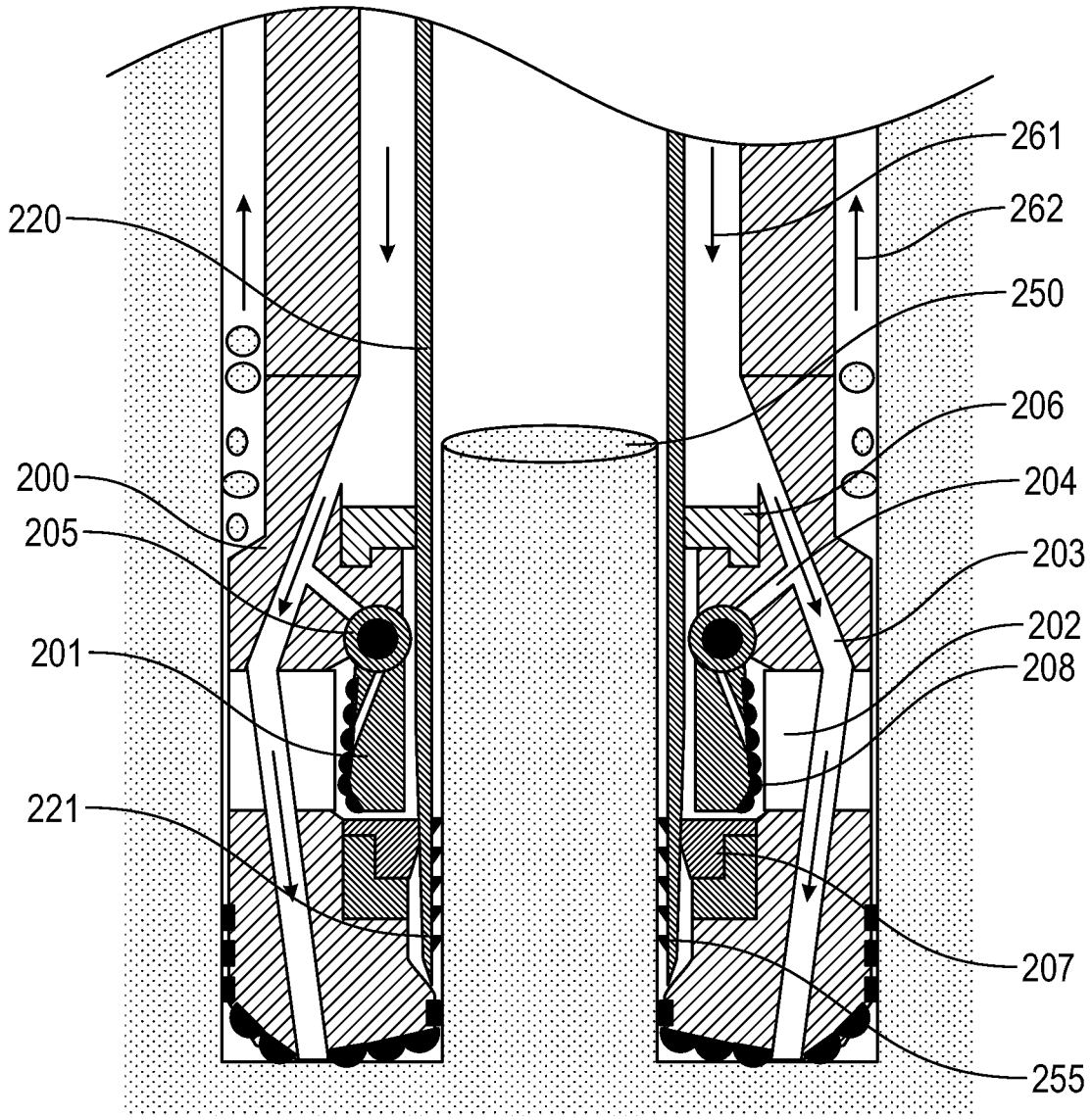
FIG. 4 shows details of an embodiment of the invention with core drill head in core sampling mode.

FIG. 4 illustrates a modified core drill head 200 core sampling and collection mode. The core drill head 200 may in its predominant features be similar to other core drill heads existing in the industry and cut a core sample 250 by means of embedded cutting implements 208 such as e.g. poly-crystalline diamond compact cutters or similar and having a center opening substantially of the same diameter as the core sample 250 being collected. However, to serve the additional objective of also being able to drill or disintegrate rock in the full surface area of the bottom of the borehole, some additional features and functionalities are required.

In the disclosed embodiment, the inner wall of the center opening in the core drill head 200 has been equipped with hinged closure elements 201 in the shape of lids that each cover a portion of the center opening, each comprising embedded cutting implements 208. It may easily be inferred that there could be two such closure elements 201, each substantially covering ½ of the center opening, or three closure elements 201 covering one third each, and so forth. Other geometries such as blocks or wedges are also feasible.

In the disclosed embodiment, the closure elements 201 are placed next to each other around the circumference of the inner opening of the core drill head 200 and open downwards. In conjunction, they may work similarly to a flapper valve, with e.g. a two-, three-, or four-way split lid. The hinge elements 205 of the closure elements 201 may comprise torsion springs for holding the elements in closed position if no inner tubing 220 is present. However, as the inner tubing 220 is lowered toward the cutting surface of the core drill head 200, the lids will be opened by the inner tubing 220 and pushed toward the inner wall of the core drill head 200. Flow channels 203 and upper and lower seals 206, 207 may be included in the body of the core drill head 200 to control the internal drilling fluid 260 flow to desired areas. Larger drill head openings 202 may be placed between the upright cutting vanes of the core drill head 200 for expulsion and removal of rock cuttings into the borehole annulus 262 when the system is used in full-bore drilling mode.

FIG. 5 illustrates the corresponding embodiment of the modified core drill head 200 in full-bore drilling mode. The inner tubing 220 is retracted, with the end of the inner tubing end 221 pulled back a few inches and the core sample 250 is kept in the inner tubing 220 by the core catcher. Retracting the inner tubing 220 enables the torsion springs in the hinge elements 205 of the closure element 201 hinges to close the closure elements 201. This action will also open a channel branch 204 of the internal fluid channels in the core drill head 200, allowing a fraction of the internal flow of the drilling fluid 260 to reach the surface of the closure elements 201 that is proximal to the cutting surface of the core drill head 200. Said surface of the closure elements 201 has cutting implements 208 imbedded, such as industry standard PDC cutters. An upper seal 206 prevents the system internal flow of the drilling fluid 260 from creating turbulence below the distal inner tubing end 221 and ensures that most of the flow is directed toward the cutting surfaces. As drilling progresses, rock that has not been cut by the main cutting surface of the core drill head 200 will protrude into the center opening and be disintegrated by the cutting implements 208 of the closure elements 201.

FIG. 6 illustrates a possible embodiment of a lifting device 230 to be positioned in the upper end of the inner tubing 220, distal to the core drill head 200. Said embodiment illustrates details of the apparatus when the lifting device 230 is in coring mode where the inner tubing 220 is lowered.

For lowering the inner tubing 220, the valve(s) 236 closes the first conduit 237 between the borehole annulus 262 and the internal upper volume 234 above the pistons and opens the second conduit 238 between both the internal upper and lower volumes 234, 235. This equalizes the fluid pressure in both the internal upper and lower volumes 234, 235 above and below the upper and lower pistons 232, 233, and since the total net piston area is largest from the top looking down, the inner tubing 220 is pushed downwards. For the floating upper piston 232, there is no difference in area above or below the sealing surface, and since the pressure is the same on both sides, this piston does not contribute in lowering the inner tubing 220. When the inner tubing 220 is in the lowered position, i.e. in coring mode, locking dogs may be seated into a groove in the outer tubing 210 or housing. This will prevent the core sample 250 from pushing the inner tubing 220 up if the frictional forces between core sample 250 and inner tubing 220 are high. In practical terms, such locking action may be achieved by for instance a spring pushing the floating piston down and wedging the pins into the groove. Unlocking would occur when the valve(s) 236 establish a difference in pressure above and below the pistons 232, 233, and the floating upper piston 232 is correspondingly pushed up, unseating the locking dogs and the upwards forces of both pistons raises the inner tubing 220.

The inner tubing 220 can be moved a short distance (a few inches) upward by means of a lifting device 230 in the upper end of the inner tubing 220, distal to the coring drill head 200 and connected to or part of the inner tubing 220 bearing assembly 222, to allow the closure elements 201 of the apparatus to close below the lowermost end of the inner tubing 220 without interfering with the already collected core sample 250.

When in coring mode, the lifting device 230 is in an extended position as illustrated in FIG. 6, i.e. with the inner tubing 220 lowered so that its distal inner tubing end 221 is close to the cutting surface of the core drill head 200, corresponding to the illustration in FIG. 4. To retract the inner tubing and enable full-bore drilling mode, corresponding to FIG. 5, one or more valves 236 open a first conduit 237 between the volume above the pistons 232, 233 and the outside of the borehole, and simultaneously closes the second conduit 238 between system internal upper and lower volumes 234, 235 above the upper piston 232 and lower piston 233. This leads to a pressure that is higher below the pistons than above and the pistons will henceforth push upwards and lift the inner tubing 220. The actuating piston is mechanically linked to the inner tubing 220 and the lifting forces originate from fluid pressure in the area below the actuating lower piston 233. The floating upper piston 232 is also lifted by the same pressure and pushes on a bracket 239 fastened to the actuating lower piston 233 with a nut.

Further, FIG. 7 illustrates said embodiment of a lifting device 230 when in full-bore drilling, corresponding to a modified core drill head 200 in the same mode as shown in FIG. 5.

It is using the flow of the internal drilling fluid 260 running through the drill string to provide the hydraulic force required for lifting the inner tubing 220. In addition to a bearing assembly 222 for the inner tubing 220, the lifting device 230 may comprise two pistons, i.e. a floating upper piston 232 and an actuating lower piston 233. Hence, there will be two effective piston areas, one for each piston, that work together to retract the inner tubing 220. The total net piston area is largest from the top looking down toward the core drill head 200. Frist and second conduits 237, 238 connect the system internal upper volume 234 above the upper piston 232 to the system internal lower volume 235 above the actuating lower piston 233 and further to the borehole annulus 262 external to the system.

With a solution as described above, no additional power source is required for the cutting action, i.e. for the disintegration of the rock: When the cutting implements 208 are connected via the closure elements 201 to the drill head 200 or to the outer tubing 110, the rotational forces of the drill string will be transferred to the cutting implements 208 and thus provide sufficient force to disintegrate the rock formation whenever the drill string is in rotation. Furthermore, when positioning the closing device and cutting implements 208 in close proximity to the cutting surface of the coring drill head 200, the risk of core jamming will be reduced in comparison to having a cutting device further up in the tubing.

The closure element 201 may comprise a number of lids, blades or arms that can be retracted, or substantially retracted, into the wall of the coring drill head 200 or the outer tubing 210. When in the closed position, these elements interlock, or rest against the coring drill head 200 or outer tubing body, in such a manner that the elements can carry the loads required for drilling ahead, without being deformed. The surface of the closure elements 201 that is proximal to the cutting surface of the coring drill head 200 may have embedded cutting implements 208, such as, but not limited to, poly-crystalline diamond compacts (PDC), diamond matrix, or steel teeth. In one embodiment, the closure elements 201 may open or close depending on the position of the inner tubing 220, by means of an arrangement of pistons or springs. In another embodiment, the closure elements 201 may open or close by means of an electric or hydraulic motor.

A lifting device 230 may be connected to the bearing assembly 222, which carries the inner tubing 220, controlling the position of the bearing assembly 222 along the longitudinal axis of the core drilling assembly. In one embodiment, the lifting device 230 may be operated by means of an arrangement of valves 236 and pistons 232, 233 to redirect flow of the drilling fluid 260 internally in the system, thus using the hydraulic force of the drilling fluid 260 to power the lifting device 230. The lifting action may be achieved by utilizing the principle of differential pressure and net piston area; a more detailed description is provided below.

A controller device 231 may be used to activate or de-activate said valves 236 and pistons 232, 233, thus controlling the direction of travel for the inner tubing 220. Activation may be initiated automatically from downhole data processors, or through a command sent from surface, e.g. a pressure pulse, changes in the flow of the drilling fluid 260, changes in the drill string revolution speed, an electronic data packet via a wired drill string, or other convenient means. In another embodiment, the lifting device 230 could be powered by means of e.g. an electric motor or winch, a magnetic device, a fluid displacement engine, a piston with its own hydraulic chamber, or some other suitable solution.

In one embodiment, the downhole core drilling assembly may also contain sensors for measuring physical parameters of the subterranean formation, the core sample 250, the drilling fluid 260, or of the downhole technology. Sensors may be included to verify activation of the closure element 201 or to determine the position of the closure elements 201. A variety of sensors and measurements to determine parameters of the subsurface rock formation or the core sample 250 may be included.

Furthermore, sensors and data processors to measure the dynamics of the drilling process may be implemented in the assembly, to determine parameters such as load, strain, pressure or vibrations on the closure elements 201 or other parts of the core drilling assembly. Any such sensors may be placed in the coring drill head 200 itself, or in the outer tubing 210 or inner tubing 220. Furthermore, sensors may be included to measure the length of the core that is entering the inner tubing 220. This may be used to provide critical data regarding the start and the end of each cored section, the length of each cored section, and the total length of core collected by the inner tubing 220. Markers may be placed on the core at regular intervals, or at the bottom of each cored section for instance when closing the internal cutter mechanism, for the purpose of separating the sections of core samples 250 and match the actually collected core interval with the corresponding lengths estimated on surface during coring.

Similarly, a lifting device 230 may include sensors to determine parameters such as piston position, valve position, pressure etc. This information may be processed downhole and utilized in an automatic process in the core drilling assembly, and/or transferred to surface in real time through available means, such as mud pulse telemetry, electromagnetic pulses, or wired pipe. Relevant information may also be used to determine whether core samples 250 should be collected from the particular geological sequence being drilled.

The invention further comprises a method for changing between drilling and coring modes of an apparatus for combined drilling and coring operations in a wellbore without tripping. Said apparatus comprises a core drilling assembly with a coring drill head 200 and a core bit, an outer tubing 210 for conveying forces to the core bit, an inner tubing 220 with an upper end connected to a bearing assembly 222 and a lower end adapted for receiving a core sample 250.

The method for changing between modes is characterized by activating or deactivating closure elements 201, that are connected to the core drilling assembly at the lower end and below the opening of the inner tubing 220, between an open or closed position for opening or closing access to the inner tubing 220, and where the closure elements 201 are provided with embedded cutting implements 208 for cutting the core material when in a closed position.

In one embodiment, controlled coring is performed by selectively activating and deactivating the closure elements 201, while continuously drilling through a formation, thereby providing core samples 250 at different stratigraphic levels. According to one embodiment, activation and deactivation of the closure elements 201 are performed by redirecting the flow of the drilling fluid 260 running between the inner tubing 220 and outer tubing 210. According to another embodiment, activation and deactivation of the closure elements 201 are performed by using an electromotor and/or integrated hydraulics.

In one embodiment of the method, activating of the drilling mode is performed by closing the closure elements 20 I thereby preventing core material from entering the inner tubing 220, and cutting core material with said embedded cutting implements 208 and letting it exit to the borehole annulus via drill head openings 202 provided in the wall of the coring drill head 200. Activating of coring mode is performed by opening the closure elements 201 allowing core sample 250 to enter the inner tubing 220.

In one embodiment, activation of the closure elements 201 is performed by moving the inner tubing 220 a short distance, e.g. a few inches upwards by means of a lifting device 230. Similarly, deactivation of the closure elements 201 is performed by moving the inner tubing 220 a short distance downwards by means of the lifting device 230.

The inner tubing 220 may in one embodiment be moved by connecting a lifting device 230 to its upper end or to the bearing assembly 222, which carries the inner tubing 220. By moving the inner tubing 220, the position of the bearing assembly 222 along the longitudinal axis of the core drilling assembly can be controlled.

By moving the inner tubing 220 upwards, the closure elements 201 of the lifting device 230 will be closed below the lowermost end of the inner tubing 220 without interfering with already collected core sample 250.

As understood from the description above, core samples 250 at different stratigraphic level may be obtained by selectively activating and deactivating the closure elements 201 while continuously drilling through a formation. As described, the activation and deactivation can be performed in different ways.

The present invention provides an apparatus and method for providing vital infom1ation related to selected core samples 250 of a formation being drilled without having to perform tripping operations.

The invention claimed is:

1. An apparatus for combined coring and drilling in a wellbore, comprising a core drilling assembly with a coring drill head, an outer tubing for conveying forces to the drill head, an inner tubing with an upper end connected to a bearing assembly and a lower end adapted for receiving a core sample, further comprising:

a lifting device, for controlling the position of the inner tubing along the longitudinal axis of the core drilling assembly, that is connected to or is arranged as a part of the bearing assembly;

closure elements with embedded cutting implements for cutting the core sample, and wherein the closure elements are connected to the core drilling assembly at the lower end and below the opening of the inner tubing such that, when in an open position the closure elements enable the core sample to enter the inner tubing, and when in a closed position the closure elements cut core material and prevent core material from entering the inner tubing, where the core material exits to the borehole annulus via drill head openings provided in a wall of the coring drill head, and one or more controller device(s) for controlling activation and deactivation of the closure elements.

2. The apparatus of claim 1, wherein the closure elements are connected to the outer tubing.

3. The apparatus of claim 2, wherein the closure elements are hinged to the outer tubing.

4. The apparatus of claim 1, wherein the closure elements are connected to the coring drill head.

5. The apparatus of claim 4, wherein the closure elements are hinged to the drill head.

6. The apparatus of claim 1, wherein the lower end of the inner tubing comprises retention means for preventing a collected core sample from exiting the inner tubing.

7. The apparatus of claim 1, wherein one or more sensors are installed in the coring drill head itself, or in the outer tubing or inner tubing for detecting properties of a coring process, the core sample, and of surrounding formations.

8. The apparatus of claim 7, wherein the sensors are connected to the one or more controller device(s) for controlling operation of coring or drilling modes.

9. The apparatus of claim 1, wherein the lifting device is operated by a flow of drilling fluid by means of one or more conduits, valves and pistons arranged in the outer tubing, thus using the hydraulic force of the drilling fluid to power the lifting device.

10. A method for changing between drilling and coring modes of an apparatus for combined drilling and coring operations in a wellbore, wherein said apparatus comprises a core drilling assembly with a coring drill head, an outer tubing for conveying forces to the drill head, an inner tubing with an upper end connected to a bearing assembly and a lower end adapted for receiving a core sample, wherein changing between modes while drilling comprises:

activating or deactivating closure elements that are connected to the core drilling assembly at the lower end of the core drilling assembly and below an opening of the inner tubing, between an open or closed position for opening or closing access to the inner tubing and where the closure elements are provided with embedded cutting implements for cutting a core material when in a closed position, and wherein activation and deactivation of the closure elements are performed with a lifting device for controlling the position of the inner tubing along the longitudinal axis of the core drilling assembly.

11. The method of claim 10, further comprising:

activating drilling mode by closing the closure elements thereby preventing core material from entering the inner tubing, and cutting core material with said embedded cutting implements and letting disintegrated core material exit to the borehole annulus via drill head openings provided in a wall of the coring drill head, and activating coring mode by opening the closure elements thereby allowing the core sample to enter the inner tubing.

12. The method of claim 10, wherein controlled coring is performed by selectively activating and deactivating the closure elements, while continuously drilling through a formation, thereby providing core samples at different stratigraphic levels.

13. The method of claim 10, further comprising activating or deactivating the closure elements by redirecting flow of the drilling fluid running between the inner tubing and outer tubing.

14. The method of claim 10, further comprising activating or deactivating an internal lifting device for moving the inner tubing away from or toward the end of the coring head.

15. The method of claim 14, further comprising activating or deactivating the lifting device by redirecting flow of the drilling fluid running between the inner tubing and outer tubing.

* * * * *